US007252687B2

(12) United States Patent
Chandrabose et al.

(10) Patent No.: US 7,252,687 B2
(45) Date of Patent: Aug. 7, 2007

(54) PROCESS FOR MAKING WET-PINK LEATHER

(75) Inventors: Murugan Chandrabose, Chennai (IN); Nishtar Nishad Fathima, Chennai (IN); Kalarical Janardhanan Sreeram, Chennai (IN); Jonnalagadda Raghava Rao, Chennai (IN); Balachandran Unni Nair, Chennai (IN); Thirumalachari Ramasami, Chennai (IN)

(73) Assignee: Council of Scientific and Industrial Research, New Delhi (IN)

( * ) Notice: Subject to any disclaimer, the term of this patent is extended or adjusted under 35 U.S.C. 154(b) by 232 days.

(21) Appl. No.: 11/020,501

(22) Filed: Dec. 23, 2004

(65) Prior Publication Data

US 2006/0137101 A1 Jun. 29, 2006

(51) Int. Cl.
*C14C 3/04* (2006.01)
*C14C 13/00* (2006.01)

(52) U.S. Cl. ..... 8/94.26; 8/94.15

(58) Field of Classification Search ..... 8/94.1 R, 8/94.19 R, 94.1 P, 94.25, 94.26, 94.15
See application file for complete search history.

(56) References Cited

U.S. PATENT DOCUMENTS 2,264,414 A * 12/1941 Somerville et al. ..... 8/94.26
3,104,151 A * 9/1963 Windus et al. ..... 8/94.33
4,272,242 A * 6/1981 Plapper et al. ..... 8/94.18
5,376,142 A * 12/1994 Matthews et al. ..... 8/94.18

* cited by examiner

*Primary Examiner*—Lorna M. Douyon
*Assistant Examiner*—Amina Khan
(74) *Attorney, Agent, or Firm*—Drinker Biddle & Reath LLP; Daniel A. Monaco, Esq.

(57) ABSTRACT

A process of combination tannage is disclosed whereby Zirconium salt is complexed with THP salt to produce wet pink leather without using any conventional dye. The resulting leathers exhibit a shrinkage temperature of more than 100° C., and other properties comparable to those of conventionally processed leathers.

9 Claims, No Drawings

PROCESS FOR MAKING WET-PINK LEATHER

FIELD OF THE INVENTION

The present invention provides a process for manufacturing wet pink leather using a combination of inorganic and organic chemicals. The process is envisaged to have enormous potential application in leather processing industry for producing pink leather without employing any conventional dye.

BACKGROUND AND PRIOR ART REFERENCES

Processing of leather essentially involves pre-tanning, tanning and post-tanning operations followed by finishing. Pre-tanning involves a series of operations like soaking, liming, deliming, bating and pickling that essentially condition the hides and skins for subsequent tanning.

Leathers require to be dyed in different shades depending on the requirements of the consumer products to be made therewith. Dyeing of leather has conventionally been a post-tanning wet operation, which is usually carried out using different conventional dyestuff like acid dye, direct dye, metal complex dye etc. The emergence of the environmental concern in respect of the hazardous components associated with these dyestuffs has prompted the researchers to explore possibilities of evolving eco-benign options for colouring of leathers.

It has been an established fact that different tanstuff used for tanning impart certain colour onto the tanned leather. Vegetable tanning materials, which have traditionally been of use for leather tanning, produce brown leathers. It has been possible to produce vegetable tanned leathers of different shades by using metallic salt as striker. For example, vegetable tanning materials, in combination with iron salt, produce black leathers as studied by Raghava Rao et al (Journal of Society of Leather Technologists and Chemists, 86, 106-111, 2002).

While there has been no report on producing pink leather using vegetable tanning method along with any metal striker, the major limitation associated with the vegetable tanning materials is that they lead to excessive loading, which reduces the versatility of the resulting leather to make different end products. Moreover, vegetable tannins are also known to be hard biodegradable materials.

With the advent of the mineral tanning agents, chromium has emerged as the most popular tanning agent, which results in blue coloured leather, popularly known as wet blue. In this process, pickled pelts (hides/skins) are tanned using basic chromium sulphate. While chromium(III) salts find extensive usage in leather processing, the environmental concerns due to chromium pollution has led to the search for alternative tanning agents.

Among other mineral tanning agents, Selverangam et al (Leather Science, 11, 383, 431, 1964) studied the potential of aluminium for tanning; Covington (Journal of American Leather Chemists Association 82, 1, 1987) studied the tanning potential of titanium; Gaidau et al (Journal of Society of Leather Technologists and Chemists 82, 143, 1998) reported the tanning potency of iron and Sreeram et al (Journal of American Leather Chemists Association, 95, 324, 2000) explored the possibility of zirconium as a tanning agent. However, each one has inherent disadvantages associated with them as highlighted by Madhan et al (Journal of American Leather Chemists Association, 97, 189, 2002).

Though aluminium and titanium tanning produces white leathers they have poor hydrothermal stability. Iron tanned leathers undergo darkening of colour during ageing and also have poor strength characteristics.

Zirconium-tanned leather is usually fuller and firmer than those produced by chrome tanning. Sreeram et al patented a process for the preparation of novel organo-metallic polymeric matrix based on zirconium (Indian Patent Application No. 3077/DEL/98). The leather so produced is of a pleasing white color, has good light fastness, and is superior to alum-tanned leather and has a higher (above 90° C.) shrinkage temperature. Zirconium salts tend to be very astringent, and normally produce tight, firm leather; causes rapid tannage of the grain and produce a fine, short nap on suede leathers. Through the use of masking salts, such as acetates, the astringency can be reduced, resulting in soft, smooth-grained leather as studied by Madhan et al (Journal of American Leather Chemists Association 98, 107-114, 2003). The major limitation associated with the zirconium tanning is that the zirconium salts precipitate as basic salts at a pH higher than 2.0. Another limitation associated with this tannage is that zirconium tanning is known to produce leathers with drawn grain. However, reports are not prevalent on the adverse effects or toxicity of zirconium salts. Hence, tanning using zirconium salts would be an eco-friendly option.

Studies on tanning properties of Tetrakis hydroxymethyl phosphonium salt (THP) were carried out by Das Gupta (Journal of Society of Leather Technologists and Chemists, 86,188, 2002) as an alternative-tanning agent to the traditional chrome tanning system. Burrow et al studied the tanning potential of THP with chromium (U.S. Pat. No. 6,685,747). The effects of THPS on the shrinkage temperature of lambskins and their combinations with aluminium salts were studied. Benefits of THPS include low toxicity, low treatment levels, rapid breakdown in the environment, and no bioaccumulation. When substituted for more toxic biocides, THPS biocide provides reduced risk to both human health and environment.

No prior art is available on the production of pink coloured leather at the tanning stage without using any dye or pigment.

OBJECTS OF THE INVENTION

The main objective of the present invention is to provide a process for making wet-pink leathers.

Another objective of the present invention is to provide a process for making wet pink leather using zirconium and THPS salts.

Yet another objective of the present invention is to provide a tanning process that provides fuller, softer and smoother leathers.

Yet another objective of the present invention is to select Tetrakis hydroxymethyl phosphonium salt from Tetrakis hydroxymethyl phosphonium sulfate (THPS), Tetrakis hydroxymethyl phosphonium chloride (THPC) either individually or in any combination.

Yet another objective of the present invention is to select zirconium salt from zirconium oxychloride, zirconium sulfate either individually or in any combination.

Still another objective of the present invention is to provide a tanning process, which is eco-friendly and abates chrome pollution.

SUMMARY OF THE INVENTION

Accordingly, the present invention provides a process for making wet-pink leather, which comprises of treating pickled skins/hides with 0.5-3% w/w, of Tetrakis hydroxymethyl phosphonium salts (THP Salt) in the presence of an 20-100% w/v, of aqueous solution of common salt having concentration in the range of 6-6.5 Be' and pH in the range of 2.5-3.0 for a period in the range of 0.5-3 hrs, followed by treating the skins/hides, as obtained in step(i), with 5-10% w/w, of zirconium salt and 1-3% w/w, of organic ligand selected from a group comprising tartaric acid, citric acid, salicylic acid and phthalic acid and/or their sodium salt under dynamic condition for a period of not less than 1 hr followed by adjusting pH by conventional method in the range of 4.8-5.0 to produce wet pink leather.

DETAILED DESCRIPTION OF THE INVENTION

The process of the present invention is described below in detail:

Pickled skin/hide is treated with 0.5-3% w/w, of Tetrakis hydroxymethyl phosphonium (THP) salt in the presence of an 20-100% w/v, of aqueous solution of common salt having concentration in the range of 6-6.5 Be' and pH in the range of 2.5-3.0 for a period in the range of 0.5-3 hrs. The resulting skin/hide is treated with 5-10% w/w, of zirconium salt and 1-3% w/w, of organic ligand selected from a group comprising tartaric acid, citric acid, salicylic acid, phthalic acid and/or its sodium salt under dynamic condition. After a period of not less than 1 hr pH of the bath is adjusted in the range of 4.8-5.0 using alkali to obtain wet pink leather.

The inventive step of the present development lies in obtaining the pink colouration by way of the complexation between zirconium and THP salt, which is observed by a shift in the wavelength of UV-Vis spectra of zirconium-THP salt tanning solution towards visible wavelength region, thereby making wet pink leather without using any conventional dye.

In another embodiment of the present invention, the raw materials are selected from the group comprising skins and hides of goat, sheep, pig, cow and buffalo.

In yet another embodiment of the present invention, the Tetrakis hydroxymethyl phosphonium salt is selected from a group consisting of Tetrakis hydroxymethyl phosphonium sulfate (THPS) and Tetrakis hydroxymethyl phosphonium chloride (THPC) either individually or in any combination.

In the present invention THPC and THPS is used either individually or in any combination. THP is the main active component required. Thus there is no specific combination, because offering THP in any way serves the purpose of the invention.

In another embodiment of the present invention, wherein the organic ligand is selected from a group consisting of tartaric acid, citric acid, salicylic acid and phthalic acid and/or their sodium salt.

In another embodiment of the present invention, wherein zirconium salt used is selected from a group consisting of zirconium oxychloride and zirconium sulfate either individually or in any combination. The metallic Zr is the main active component required for the tannage. Thus there is no specific combination, because offering Zr in any way serves the purpose of the invention.

In another embodiment of the present invention, wherein during treatment of skin/hide with Tetrakis hydroxymethyl phosphonium (THP) salt pH is adjusted by using alkali selected from a group comprising sodium bicarbonate and sodium formate.

In another embodiment of the present invention, wherein wet-pink leather is obtained by complexation between zirconium and THP salt, which is effected by a shift in the wavelength of Ultraviolet-Visible spectra of zirconium-THP salt tanning solution towards visible wavelength region.

In another embodiment of the present invention, wherein the process produces soft and smooth leather.

The following examples are provided by way of illustration only and therefore should not be construed to limit the scope of the present invention.

EXAMPLE 1

Three pickled goatskins weighing 2.7 kg were taken. The pickled skins were loaded in a drum with 540 ml solution of common salt having concentration of 6 Be' and pH 2.5.

To this, 40.5 gms THPS was added to the drum. The duration of the running was 30 min. 202.5 gms of zirconium oxychloride and 67.5 gms of sodium tartarate were added to the drum. The drum was run for 60 min. Finally the basification was done to the pH 4.8, using 13.5 gms sodium formate and 81 gms sodium bicarbonate. The tanned skins were washed with 5400 ml water for 10 minutes, drained and wet pink leather was obtained.

EXAMPLE 2

Three pickled sheepskins, weighing 4.0 kg, were taken. The pickled skins were loaded in a drum with 4000 ml solution of common salt having concentration of 6.5 Be' and pH 2.8. To this, 20 gms THPC was added to the drum. The duration of the running was 60 min. 200 gms of zirconium sulfate and 40 gms of citric acid were added to the drum. The drum was run for 90 min. Finally the conventional basification was done to the pH 4.9, using 20 gms sodium formate and 120 gms sodium bicarbonate. The tanned skins were washed with 8000 ml water for 10 minutes, drained and wet pink leather was obtained.

EXAMPLE 3

Four pickled cow sides, weighing 25 kg, were taken. The pickled sides were loaded in a drum with 18750 ml solution of common salt having concentration of 6.3 Be' and pH 3.0. To this, 300 gms THPS and 200 gms THPC was added to the drum. The duration of the running was 120 min. 2500 gms of zirconium oxychloride and 650 gms of sodium phthalate and 100 gms salicylic acid were added to the drum. The drum was run for 180 min. Finally the conventional basification was done to the pH 5.0, using 125 gms sodium formate and 750 gms sodium bicarbonate. The tanned skins were washed with 50000 ml water for 10 minutes, drained and wet pink leather was obtained.

EXAMPLE 4

Three pickled buff calf skin, weighing 18 kg, were taken. The pickled skins were loaded in a drum with 18000 ml solution of common salt having concentration of 6.5 Be' and pH 2.8. To this, 540 gms THPS was added to the drum. The duration of the running was 180 min. 900 gms of zirconium oxychloride, 900 gms of zirconium sulfate, 180 gms of phthalic acid and 180 gms sodium citrate were added to the drum. The drum was run for 180 min. Finally the conventional basification was done to the pH 5.0, using 90 gms sodium formate and 540 gms sodium bicarbonate. The tanned skins were washed with 36000 ml water for 10 minutes, drained and wet pink leather obtained.

ADVANTAGES

The following are the advantages of the present invention:

1. Production of pink leathers without use of dyes and pigments.
2. This process hardly requires any complicated control measures.
3. It completely eliminates the basic chromium sulfate.
4. Suitable for all kinds of raw materials.
5. This tanning system produces full, soft and smooth leathers.
6. This process employs commercially available chemicals

The invention claimed is:

1. A process for making wet-pink leather, said process comprising the steps of:

i) treating pickled skins and/or hides in a bath comprising 0.5-3% w/w of one or more Tetrakis hydroxymethyl phosphonium salts and a 20-100% w/v aqueous solution of common salt at a pH in the range of 2.5 to 3.0 for 0.5 to 3 hours, and ii) further treating the skins and/or hides, as obtained in step(i), by adding 5-10% w/w of zirconium salt and 1-3% w/w of organic ligand to the bath, and treating said skins for a period of not less than 1 hour, followed by adjusting the pH of the bath to 4.8 to 5 to produce wet pink leather.

2. The process as claimed in claim 1, wherein the skins and/or hides are selected from the group consisting of skins and hides of goat, pig, sheep, cow and buffalo.

3. The process as claimed in claim 1, wherein the concentration of common salt in the aqueous solution is in the range of 6-6.5 Be'.

4. The process as claimed in claim 1, wherein the Tetrakis hydroxymethyl phosphonium salt is selected from the group consisting of Tetrakis hydroxymethyl phosphonium sulfate, Tetrakis hydroxymethyl phosphonium chloride, and combinations thereof.

5. The process as claimed in claim 1, wherein the organic ligand is selected from the group consisting of tartaric acid, citric acid, salicylic acid, phthalic acid, and sodium salts thereof.

6. The process as claimed in claim 1, wherein in step (ii), the pH of the bath is adjusted by alkali selected from the group consisting of sodium bicarbonate and sodium formate.

7. The process as claimed in claim 1, wherein the zirconium salt is selected from the group consisting of zirconium oxychloride, zirconium sulfate, and combinations thereof.

8. The process as claimed in claim 1, wherein the pink coloration of the wet-pink leather is obtained by complexation between zirconium and the Tetrakis hydroxymethyl phosphonium salt.

9. The process as claimed in claim 1, wherein the process produces soft and smooth leather.

* * * * *